US005455666A

United States Patent [19]

Saito et al.

[11] Patent Number: 5,455,666

[45] Date of Patent: Oct. 3, 1995

[54] DEVELOPER EXTRACTING APPARATUS AND IMAGE FORMING APPARATUS USING IT

[75] Inventors: Hironobu Saito, Yokohama; Masanari Shirai, Chigasaki; Masami Maetani, Ageo, all of Japan

[73] Assignee: Canon Kabushiki Kaisha, Tokyo, Japan

[21] Appl. No.: 266,496

[22] Filed: Jun. 27, 1994

[30] Foreign Application Priority Data

Jun. 29, 1993 [JP] Japan ..... 5-159049
Jun. 30, 1993 [JP] Japan ..... 5-161013

[51] Int. Cl.[6] ..... G03G 21/00
[52] U.S. Cl. ..... 355/298; 118/652
[58] Field of Search ..... 355/298, 304, 355/245; 118/652

[56] References Cited

U.S. PATENT DOCUMENTS 3,982,043 9/1976 Simpson ..... 355/298 X
4,054,381 10/1977 Bernard ..... 355/298 X
4,267,245 5/1981 Wada ..... 118/652 X
4,389,968 6/1983 Satomura ..... 118/652
4,595,277 6/1986 Maczuszenko et al. ..... 365/245 X
4,624,559 11/1986 Heneda et al. ..... 355/253
5,260,760 11/1993 Takemura et al. ..... 355/245 X

FOREIGN PATENT DOCUMENTS 56-165180 12/1981 Japan .
4-367873 12/1992 Japan .
5-289503 11/1993 Japan .

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

A developer extracting apparatus for extracting developer from a mixture of developer and foreign matter, includes a filter for permitting passage of developer and for inhibiting passage of foreign matter, protection means for protecting the filter, and a vibration applying means for applying vibration to the filter via the protection means.

18 Claims, 11 Drawing Sheets

DEVELOPER EXTRACTING APPARATUS AND IMAGE FORMING APPARATUS USING IT

BACKGROUND OF THE INVENTION

1. Field of the Invention

The present invention relates to a developer extracting apparatus for extracting developer from mixture a of developer and foreign matters, and an image forming apparatus using such a developer extracting apparatus. More particularly, the present invention relates to a developer extracting apparatus used with an image forming apparatus of electrophotographic type such as a copying machine, a printer and the like, and an image forming apparatus using it.

2. Related Background Art

In order to effectively utilize resources and to protect environmental conditions, there have been proposed various separating apparatuses for separating residual matter removed from an image bearing member into developer and other foreign matters and various apparatuses wherein the separated developer is reused. Among developer extracting apparatuses for extracting the developer from the residual matter removed from the image bearing member, various apparatuses using a mesh-shaped filter have been proposed. In such apparatuses, the developer is extracted by separating the developer which can pass through the mesh and the other foreign matters which cannot pass through the mesh. Further, in order to improve the separating ability and to prevent clogging of the mesh, there has been proposed an apparatus for vibrating a mesh-shaped filter (refer to Japanese Patent Laid-Open No. 56-165180). By using this apparatus, when the mesh is directly vibrated, since the vibration is effectively transmitted to the mesh, it is possible to prevent the mesh from being clogged by paper powder or the like and to improve the separating ability for separating the developer from the other foreign matters.

However, since the mesh is normally formed by weaving thin wires made of metal or resin material in a net shape, although the mesh is effectively vibrated when the vibration is applied to the mesh in the initial condition, the openings of the mesh are gradually widened due to the fact that the mesh is repeatedly beaten directly as the mesh is continuously used, with the result that the vibration transmitting efficiency deteriorates considerably, thereby reducing the separating ability.

SUMMARY OF THE INVENTION

The present invention aims to eliminate the above-mentioned conventional drawback, and an object of the present invention is to provide a developer extracting apparatus wherein developer can be extracted for a long time.

Another object of the present invention is to provide an image forming apparatus which can utilize developer effectively.

A further object of the present invention is to provide a developer extracting apparatus and an image forming apparatus wherein a filter for separating developer from the other foreign matters can be used for a long time.

A still further object of the present invention is to provide a developer extracting apparatus and an image forming apparatus which comprise a filter through which developer can pass but the other foreign matters cannot pass, a protection member for protecting the filter, and a vibration applying means for applying vibration to the filter via the protection member.

Other objects and features of the present invention will be apparent from the following detailed explanation referring to the accompanying drawings.

DETAILED DESCRIPTION OF THE PREFERRED EMBODIMENTS

Figure 1:
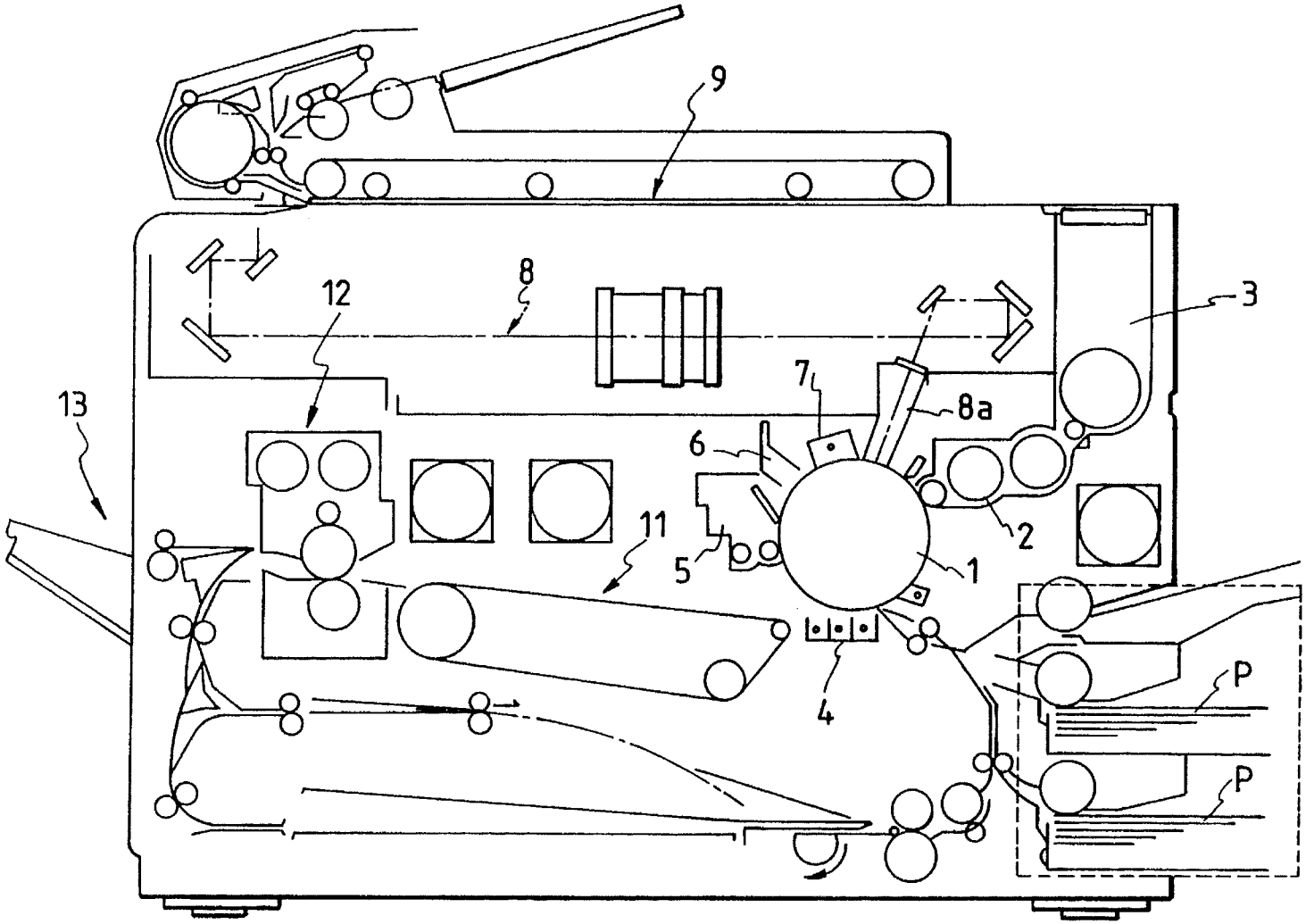
FIG. 1 is a schematic sectional view of an image forming apparatus to which the present invention is applied.
Figure 2:
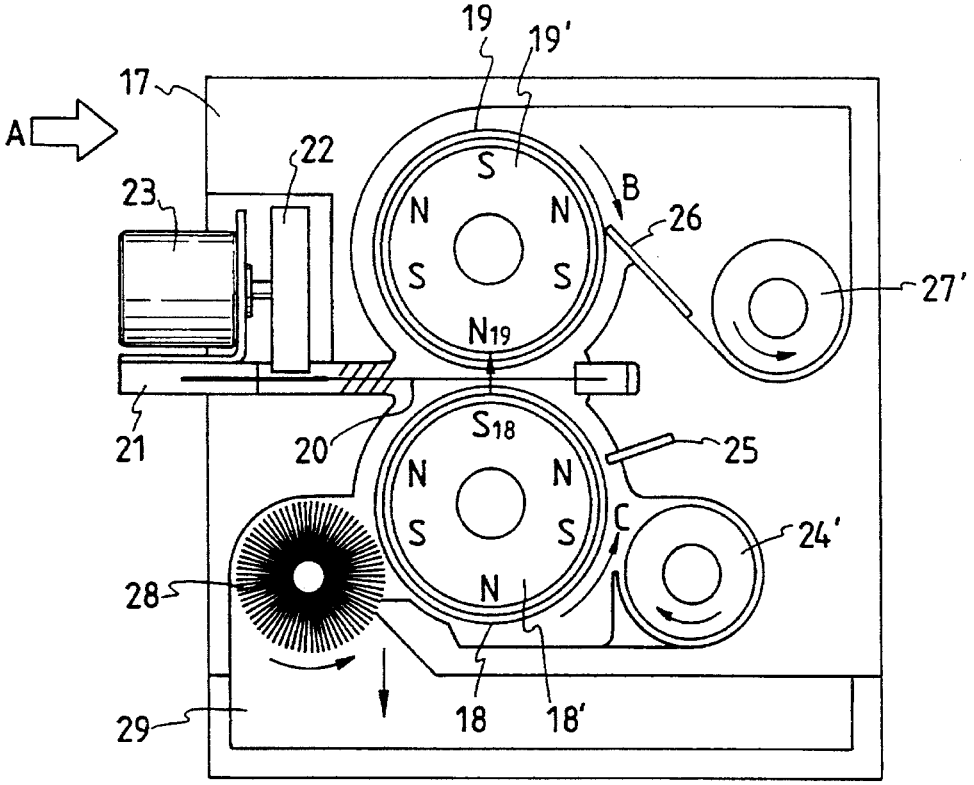
FIG. 2 is a sectional view of a developer extracting apparatus according to a first embodiment of the present invention.
Figure 3:
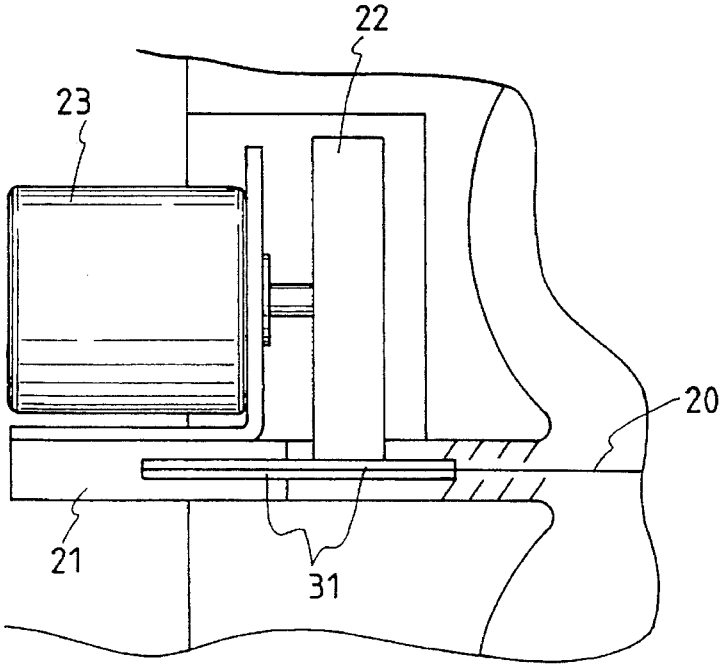
FIG. 3 is a enlarged sectional partial view of a vibration applying portion of the developer extracting apparatus of FIG. 2.
Figure 4:
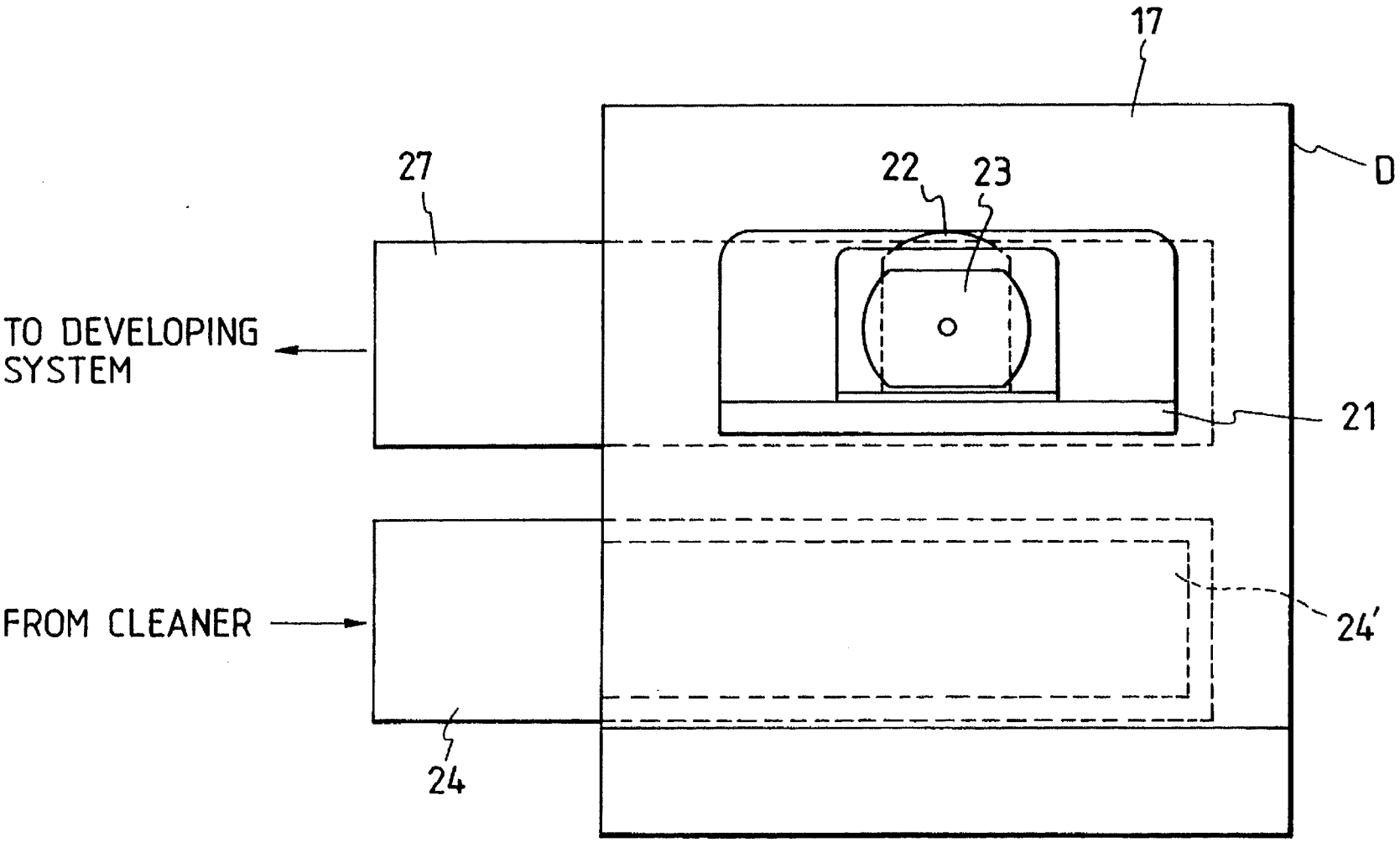
FIG. 4 is a side view from a direction shown by the arrow A in FIG. 2.

FIG. 1 is a schematic sectional view of an image forming apparatus to which the present invention is applied, FIG. 2 is a sectional view of a developer extracting apparatus for extracting developer from a residual matter removed from a surface of an image bearing member by cleaning means. FIG. 3 is a view showing a mesh vibration applying portion in detail, and FIG. 4 is a side view of the developer extracting apparatus viewed from a direction shown by the arrow A in FIG. 2.

Now, an image forming process of the image forming apparatus will be explained.

A rotating photosensitive drum (image bearing member) 1 is firstly charged uniformly by a charger 7. Then, the photosensitive drum is exposed by light 8*a* reflected from an original rested on an original support 9 through an optical system 8, thereby forming an electrostatic latent image on the photosensitive drum. The latent image is visualized with one-component developer including magnetic toner supplied from a developing device 2 to form a toner image. Then, the toner image formed on the photosensitive drum 1 is transferred onto a recording material P by a transfer charger 4. The recording material P to which the toner image was transferred is sent, by a convey belt 11, to a fixing device 12, where the toner image is fixed to the recording material P. Thereafter, the recording material P is discharged onto a sheet discharge tray 13. After the transferring operation, residual toner and foreign matters such as a paper powder (referred to as "residual matter" hereinafter) remaining on the photosensitive drum 1 are removed from the drum by a cleaning device 5. Thereafter, electricity on the photosensitive drum 1 is removed by a pre-exposure device 6 for preparation for next image formation.

In the image forming apparatus shown in FIG. 1, foreign matters such as paper powder are removed from the residual matter removed from the photosensitive drum, and only the residual toner is sent to a hopper 3 of the developing device 2 for re-use. Then, a developer extracting apparatus according to a first embodiment of the present invention for separating the residual matter removed from the surface of the photosensitive drum into developer and other foreign matters will be explained with reference to FIGS. 2 to 4.

Within a frame 17 of the developer extracting apparatus, there are provided a terminal portion (shown by the broken line in FIG. 4) of a convey path 24 having a convey screw 24' for conveying the residual matter removed from the cleaning device 5, a sleeve 18 rotated in a direction shown by the arrow C and adapted to hold the residual matter sent from the cleaning device 5, a magnet 18' non-rotatably secured within the sleeve 18 (so that an S pole always is oriented upwardly as shown in FIG. 2), a regulating member 25 for regulating a thickness of a layer of the residual matter formed on the sleeve 18, a sleeve 19 for absorbing toner from the sleeve 18 (and rotated in a direction shown by the arrow B), a magnet 19' non-rotatably secured within the sleeve 19 (so that an N pole is always oriented downwardly as shown in FIG. 2), a scraper blade 26 for scraping toner from the sleeve 19, a start end portion (shown by the broken line in FIG. 4) of a convey path 27 having a convey screw 27' for conveying toner scraped by the scraper blade 26 toward the hopper 3 of the developing device 2, and a mesh-shaped filter 20 (formed from non-magnetic stainless steel wires, non-magnetic brass wires or nylon fibers) disposed between the sleeves 18, 19. Incidentally, the reason why the magnets 18', 19' are secured is that a strong concentrated magnetic field is always generated between the sleeves 18, 19.

Now, a separating operation for separating the toner from the other foreign matters effected by such an apparatus will be explained.

The convey screw 24' disposed in the convey path 24 extends up to the proximity of that side (corresponding to a wall D shown in FIG. 4) of the developer extracting apparatus 17 in parallel with the sleeve 18, and an opening is formed on the convey path 24 in a confronting relation to the sleeve 18. Thus, the residual matter (magnetic toner and other foreign matters such as paper powder) conveyed by the convey screw 24' is absorbed to the surface of the sleeve 18 by a magnetic force of the magnet 18' disposed within the sleeve 18 (In this case, since the non-magnetic foreign matters such as paper powder are mixed with the magnetic toner, they are absorbed to the surface of the sleeve 18 together with the magnetic toner).

The residual matter absorbed to the surface of the sleeve 18 forms a layer on the sleeve 18, and a thickness of the layer is regulated by the doctor blade 25. As the sleeve 18 is rotated, the residual matter is conveyed to an area where the sleeves 18, 19 are opposed to each other, i.e. an area where the residual matter is sufficiently influenced by the magnetic force from the sleeve 19. Then, the residual matter conveyed to a separating station opposed to the sleeve 19 is effectively attracted toward the sleeve 19 by the concentrated lines of magnetic force extending from the magnetic pole $S_{18}$ to the magnetic pole $N_{19}$. In this case, since the magnetic forces of the magnet poles $N_{19}$, $S_{18}$ in the separating station are selected to have a relation $N_{19}>S_{18}$, the toner is strongly attracted by the magnetic force of the magnetic pole $N_{19}$ to pass through the mesh and to advance upwardly. Since the mesh has openings each having a dimension greater than the particle diameter of the toner by several times (for example, in the case of toner having an average particle diameter of about 5–20 μm, each opening preferably has a dimension in a range from 37.5 μm×37.5 μm (#400) to 150 μm×150 μm (#100)), the toner can easily pass through the mesh 20, but the paper powder flying together with the toner cannot pass through the mesh. Since the paper powder is blocked by the surface of the mesh 20 confronting the sleeve 18, the paper powder separated from the magnetic toner drops onto the sleeve 18 by its own weight. The dropped material is further conveyed together with the toner (which was not absorbed to the sleeve 19) and the foreign matters (which were not flying). These toner and foreign matters are removed from the sleeve 18 by a non-magnetic brush 28 disposed downstream of the separating station. Since the non-magnetic brush 28 is abutted against the surface of the sleeve 18 with a weak urging force, foreign matters such as paper powder adhered to the sleeve 18 with a weak adhering force can be removed from the sleeve by the brush, but, since residual toner (which was not separated at the separating station) remaining on the sleeve is adhered to the sleeve by a magnetic force, such residual toner cannot be removed from the sleeve by the non-magnetic brush 28 and is further conveyed downstreamly for the next separation. Thus, the magnetic toner is not substantially collected in a collecting portion 29, but, only the non-magnetic foreign matters are collected in the collecting portion 29.

In the apparatus according to the present invention, as shown in FIG. 3, flexible sheets (protection members) 31 are arranged on a portion of the mesh-shaped filter 20 so that vibration is applied to the mesh 20 via the flexible sheets (in the first embodiment shown in FIG. 3, one end portion of the mesh 20 is pinched by a pair of flexible sheets 31).

Further explaining the first embodiment of the present invention in detail, the portion of the mesh 20 to which the vibration is applied is pinched by the flexible sheets 31 each having a thickness of 0.05–0.2 mm (preferable, made of material maintaining a restoring ability for a long time even when it is deformed by an urging force of a cam 22, and, more preferably, formed from a leaf spring made of non-magnetic material such as stainless steel or phosphoric bronze), and the cam 22 rotated by a motor 23 is abutted against one of the flexible sheets 31. In this case, the vibration applied to the sheets 31 by the cam 22 preferably has a frequency of 50 Hz or more and an amplitude of about 0.2–4 mm. Further, the motor 23 is attached to a holding member 21 for holding one end portion of the mesh 20 pinched by the flexible sheets 31. Incidentally, the mesh is held by pinching it between the sheets and the holding member 21, and the sheets 31 are adhered to the holding member. Further, although the mesh 20 may or may not be adhered to the sheets 31, it is preferable that the mesh is adhered to the sheets since the vibration can be transmitted to the mesh more effectively.

With this arrangement, since the flexible sheet 31 is arranged on the portion of the mesh 20 and the vibration is applied to the mesh 20 via the sheet 31, it is possible to keep the openings of the mesh from being widened and to maintain the excellent separating ability for a long time. Further, when a pair of flexible sheets 31 are arranged on both sides of the mesh 20, even if the sheets 31 are thin, since the restoring force or elastic force of the sheets 31 can be maintained for a long time, the transmitting ability for the vibration generated by the cam 22 can be maintained effectively for a long time.

Further, since the sheet 31 has a thickness of 0.05–0.2 mm, even when the sheet is vibrated by the cam 22, the vibration noise can be minimized. It is preferable that the mesh 20 and the sheet(s) 31 are made of non-magnetic material since there is no magnetic adhesion between the mesh/sheet and the toner (developer) and, thus, the adhesion of the developer which makes the transmission of the vibration to the mesh 20 can be prevented.

In the first embodiment, the eccentric cam is secured to an output shaft of the motor (vibration applying means) so that the flexible sheets are positively displaced by the cam to apply the vibration to the flexible sheets. However, in a second embodiment of the present invention which will be described hereinbelow, a solenoid is used as a drive source of a vibration applying means.

Figure 5:
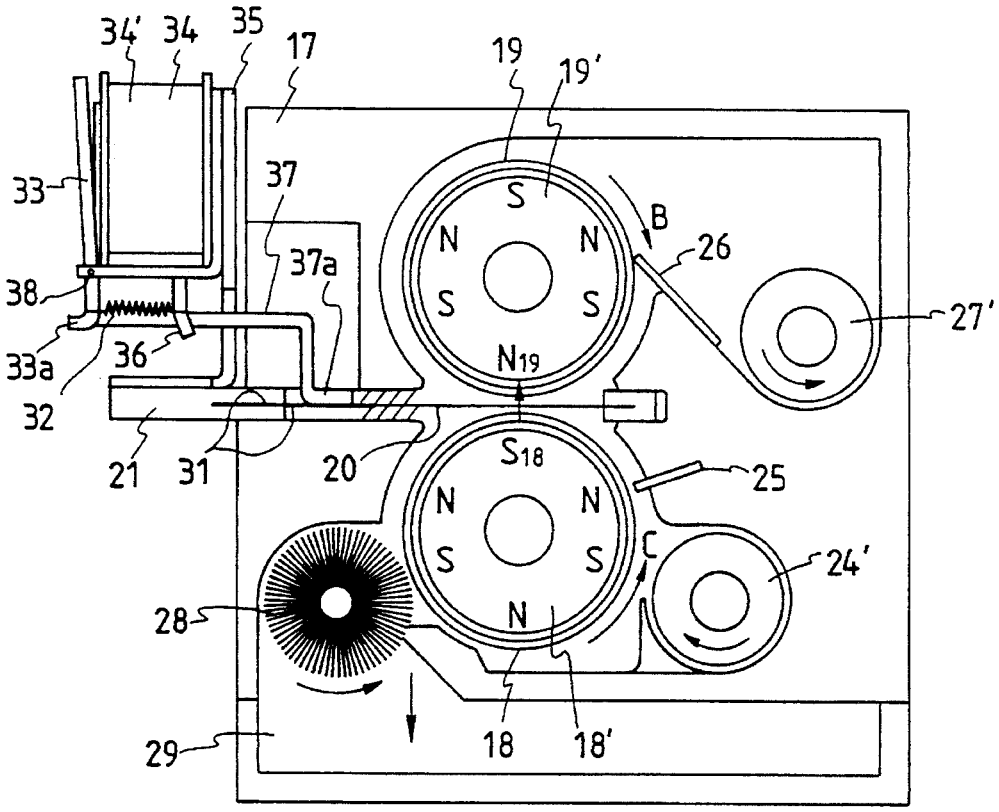
FIG. 5 is a sectional view of a developer extracting apparatus according to a second embodiment of the present invention.

In the second embodiment, as shown in FIG. 5, a solenoid 34 is attached to a metal plate 35 secured to the holding member 21, a vibration plate 33 is abutted against a displacement portion 34' of the solenoid 34, and a tension spring 32 is arranged between an end 33*a* of the vibration plate 33 and a projection 36 attached to the metal plate 35. By ON/OFF controlling the solenoid 34 with high frequency, the vibration plate 33 is rocked around a fulcrum 38. A leaf spring 37 is secured to the vibration plate 33 so that, when the vibration plate 33 is rocked, the vibration is applied to flexible sheets 31 similar to those of the first embodiment via a tip end portion 37*a* of the leaf spring 37. In this way, when the ON/OFF controlled solenoid associated with the flexible sheets is used as the vibration applying means, since the wear of the surface of the flexible sheet 31 can be further suppressed, the service life of the flexible sheet can be increased.

In the above-mentioned first and second embodiments, an example that the durability of the mesh-shaped filter is increased by providing the flexible sheet(s) as a part of the vibration applying means for applying the vibration to the mesh-shaped filter is shown. However, in a third embodiment of the present invention which will be described herein below, there is provided an apparatus wherein the durability of the mesh-shaped filter can be further increased. Incidentally, the same elements as those in the first and second embodiments are designated by the same reference numerals.

Figure 6:
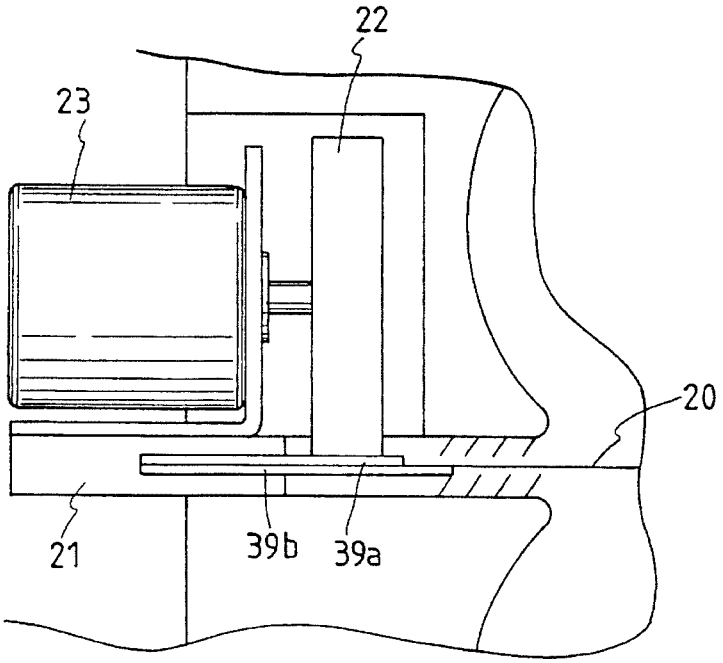
FIG. 6 is an enlarged sectional partial view of a vibration applying portion of a developer extracting apparatus according to a third embodiment of the present invention.
Figure 7:
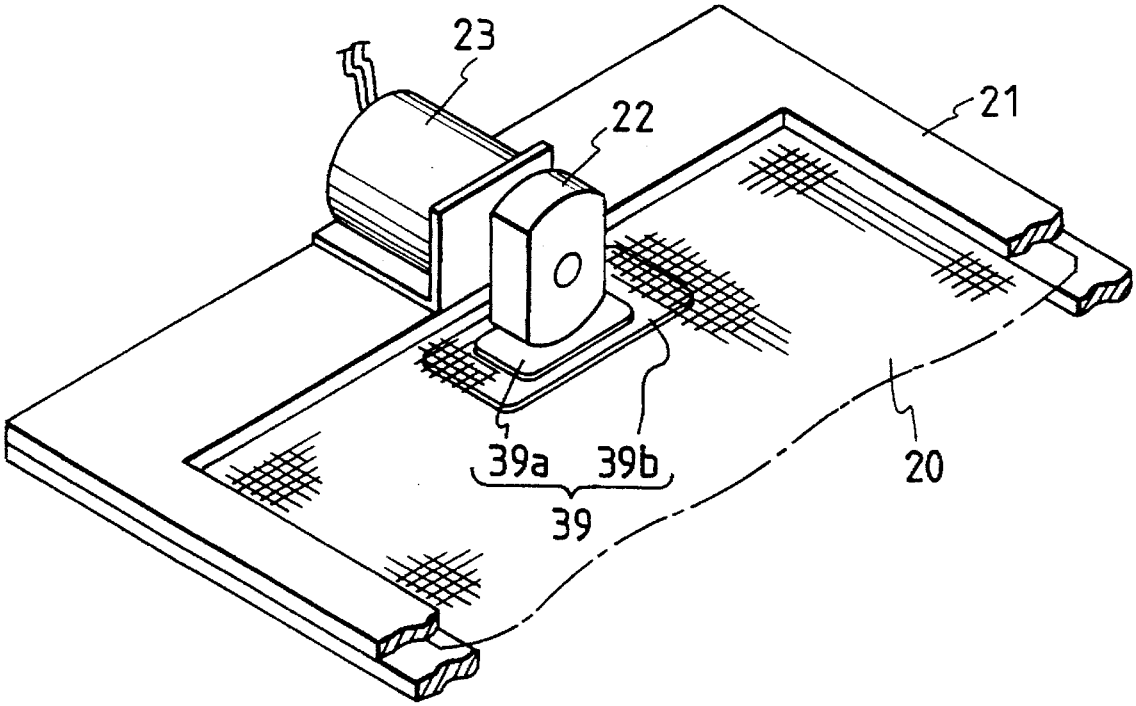
FIG. 7 is a perspective view of the vibration applying portion of FIG. 6.

FIG. 6 is a detailed view showing a vibration applying portion according to the third embodiment, and FIG. 7 is a perspective view of the vibration applying port ion of FIG. 6.

As is in the above-mentioned embodiment, the mesh-shaped filter 20 is supported by the holding member 21, and a portion of the mesh is pinched between a pair of flexible sheets 39*a*, 39*b*. The flexible sheet 39*a* is disposed on a front surface of the mesh 20 and is contacted with the cam 22 which forms a part of the vibration applying means. The flexible sheet 39*b* is disposed on an under surface of the mesh and is larger than the flexible sheet 39*a*. The sheets 39*a*, 39*b* are homologous with each other.

Figure 8:
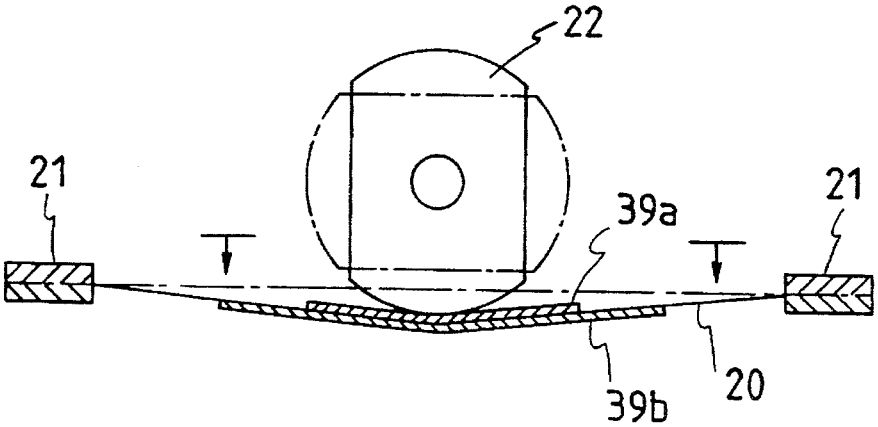
FIG. 8 is a sectional view showing a condition that a mesh is deformed when a cam is rotated.
Figure 9:
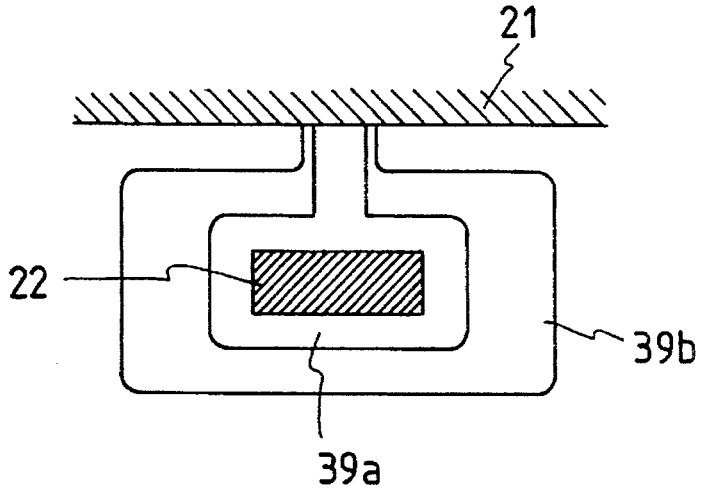
FIG. 9 is a plan view of the vibration applying portion of FIG. 6.

The solid line in FIG. 8 shows the maximum elastic deformation of the mesh 20 generated when a maximum lift portion of the cam 22 is contacted with the flexible sheets pinching the mesh, and the phantom line in FIG. 8 shows a condition that the cam 22 is not contacted with the flexible sheet 39*a*. The flexible sheet 39*a* to which the vibration is applied by contacting with the cam 22 as shown is vibrated together with the mesh 20 and the flexible sheet 39*b* on the under surface of the mesh. In this case, as shown in FIG. 9, since the flexible sheet 39*b* is larger than the flexible sheet 39*a* and is homologous with the flexible sheet 39*a*, the flexible sheet 39*b* relieves the contact between the mesh 20 and the peripheral portion of the flexible sheet 39*a*. That is to say, since the concentrated stress generated between the flexible sheet 39*a* and the mesh 20 can be dispersed by the flexible sheet 39*b* arranged on the opposite side of the flexible sheet 39*a* with the interposition of the mesh, it is possible to prevent the openings of the mesh corresponding to the peripheral portion of the sheet 39*a* from being widened, thereby minimizing the damage of the mesh.

Figure 10:
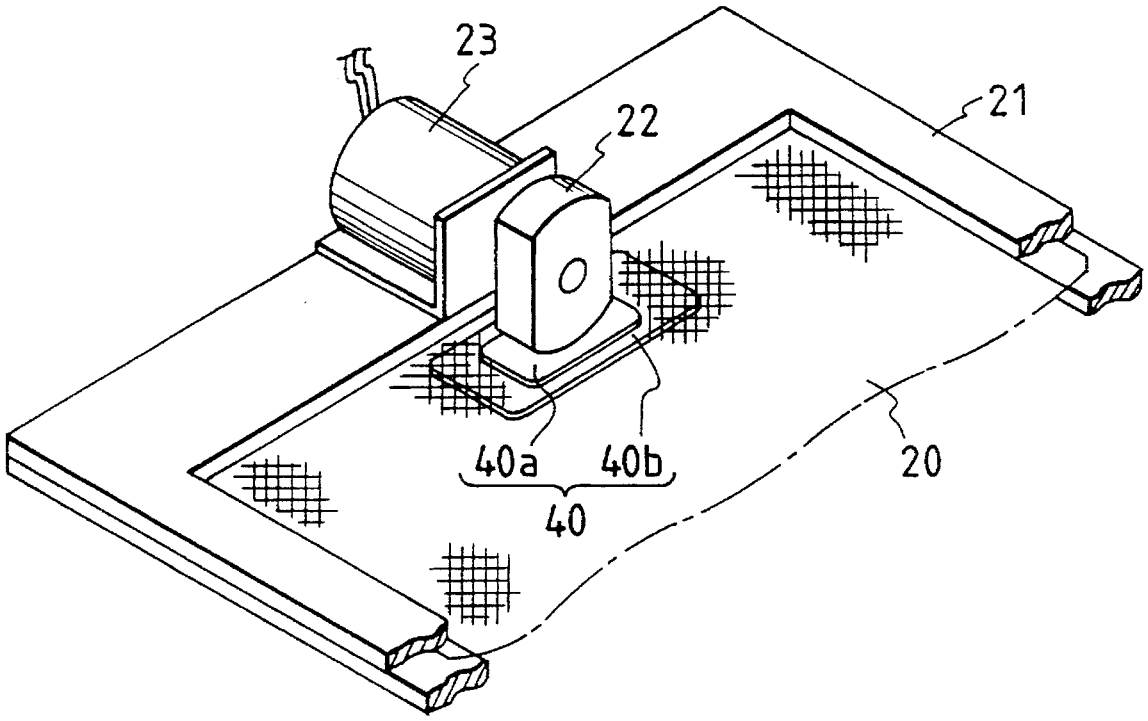
FIG. 10 is a perspective view of a vibration applying portion of a developer extracting apparatus according to a fourth embodiment of the present invention.
Figure 11:
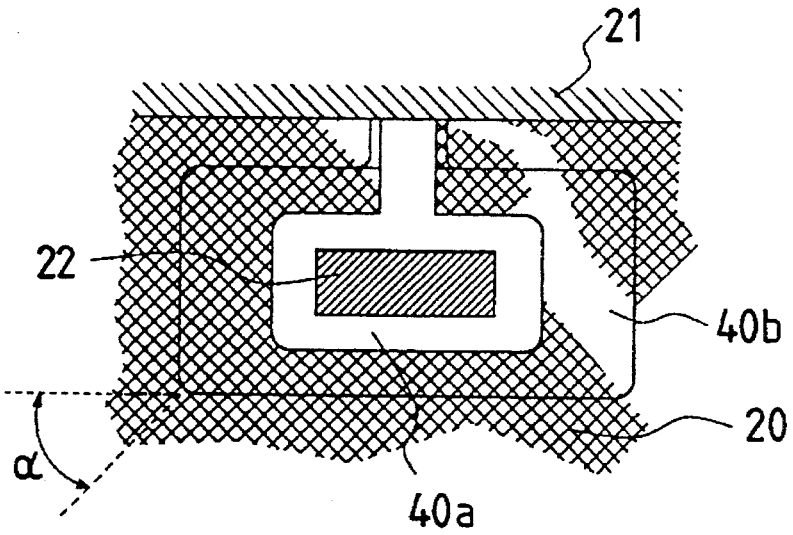
FIG. 11 is a plan view of the vibration applying portion of FIG. 10.

FIG. 10 shows a fourth embodiment of the present invention and is a perspective view showing a vibration applying means and a mesh supporting member. In FIG. 10, the mesh 20 is held by the holding member (mesh supporting member) 21 and a portion of the mesh is pinched between a pair of flexible sheets 40*a*, 40*b*. The flexible sheet 40*a* is disposed on a front surface of the mesh 20 and is contacted with the cam 22 which forms a part of the vibration applying means. The flexible sheet 40*b* is disposed on an under surface of the mesh and is larger than the flexible sheet 40*a*. The sheets 40*a*, 40*b* are homologous with each other. Further, an angle $\alpha$ between a weaving direction of the mesh 20 and the profiles of the flexible sheets is selected to be about 45 degrees (see FIG. 11).

Figure 12:
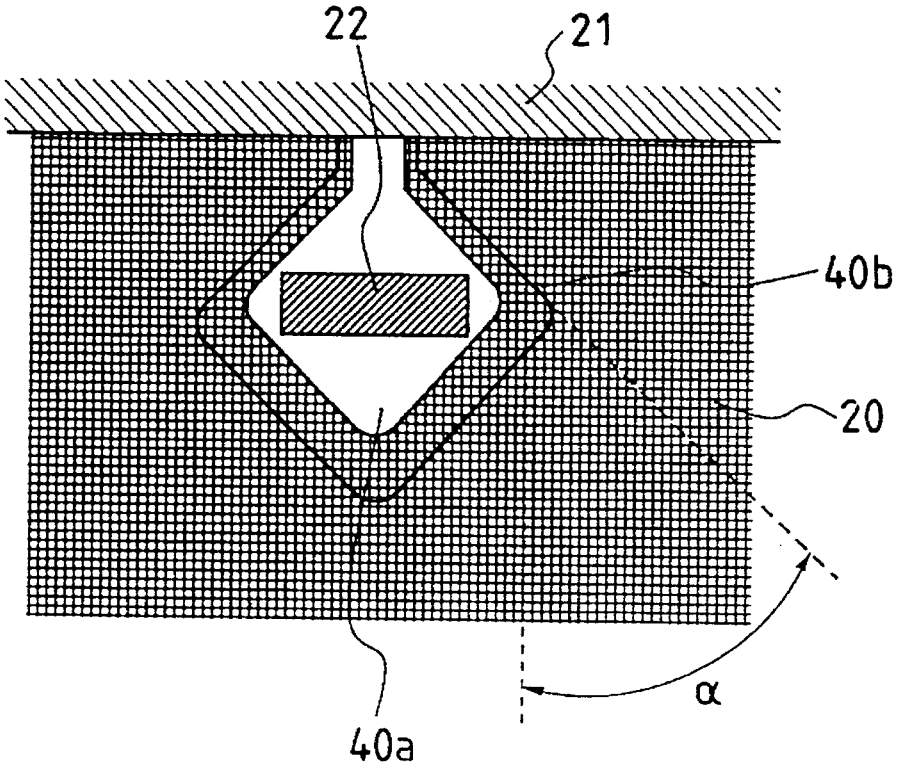
FIG. 12 is a plan view of a vibration applying portion of a developer extracting apparatus according to a fifth embodiment of the present invention.
Figure 13:
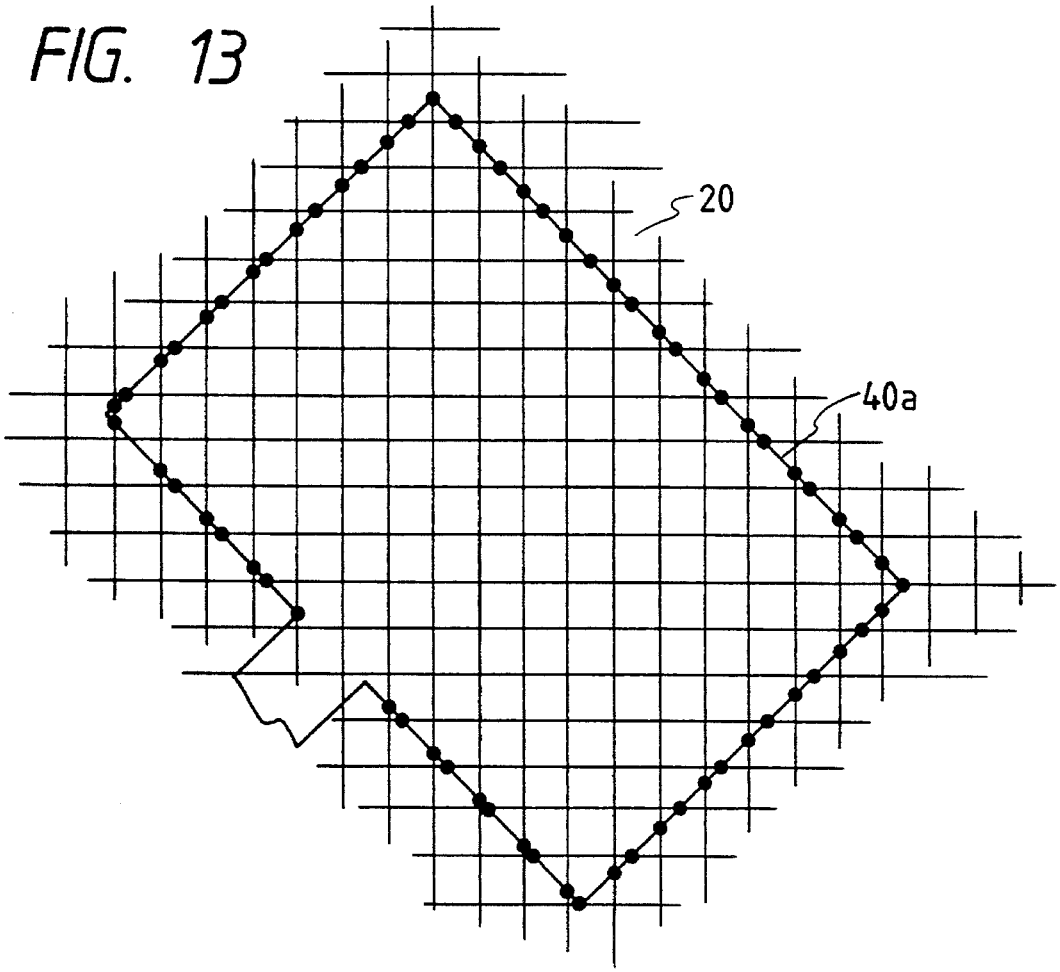
FIGS. 13 and 14 are views showing contact points between a mesh and a flexible sheet.
Figure 14:
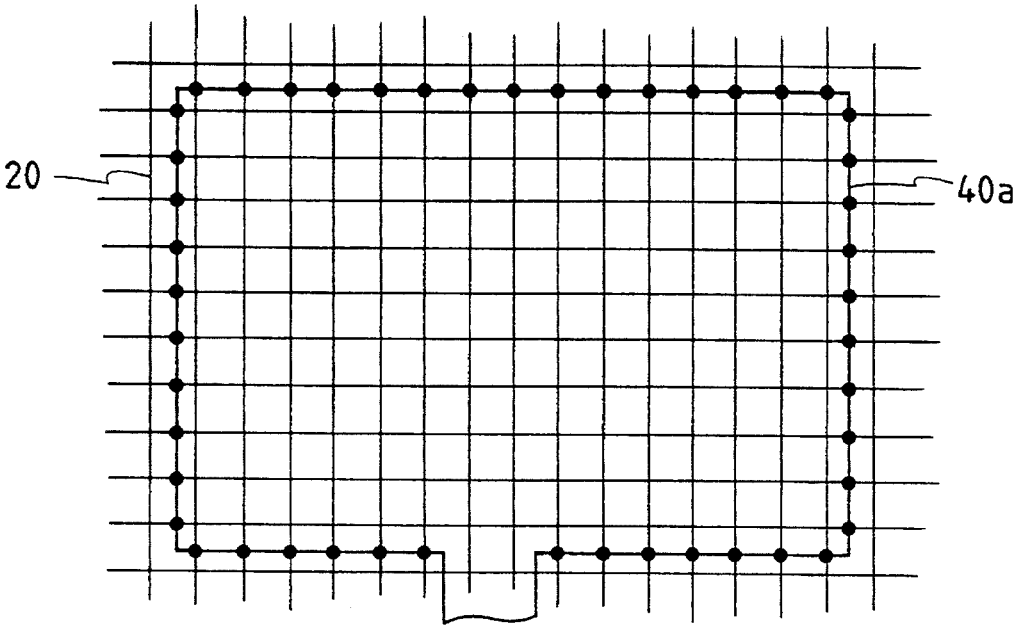

FIG. 12 shows a fifth embodiment of the present invention and is a view showing a relative positional relation between a mesh 20 and flexible sheets 40*a*, 40*b*. In this embodiment, it is designed so that the weaving directions of the mesh are parallel and perpendicular with respect to one side of the holding member 21 and the profiles of the flexible sheets are inclined by about 45 degrees with respect to the weaving direction of the mesh. FIGS. 13 and 14 are views showing contacting point between the mesh 20 and the flexible sheet 40*a*. An area of the flexible sheet 40*a* shown in FIG. 13 is the same as that shown in FIG. 14. FIG. 13 shows a condition that an angle between the weaving direction of the mesh 20 and any edge of the flexible sheet 40*a* is about 45 degrees, and FIG. 14 shows a condition that an angle between the weaving direction of the mesh 20 and any edge of the flexible sheet 40*a* is zero or 90 degrees. Comparing the number of contact points between the mesh 20 and the periphery of the flexible sheet 40*a* in FIG. 13 and that in FIG. 14, the number of contact points in FIG. 13 is 68, and the number of contact points in FIG. 14 is 47. Accordingly, in the case where the flexible sheet has the same area, when the angle between the weaving direction of the mesh 20 and any edge of the flexible sheet 40*a* is about 45 degrees, since the concentrated stress acting on the mesh can be supported by a greater number of contact points, the damage of the mesh is reduced.

In this way, by selecting the attachment angle $\alpha$ of the flexible sheet with respect to the mesh to have a relation $0°<\alpha<90°$, it is possible to reduce the damage of the mesh due to the vibration, thereby increasing the durability of the mesh.

Next, a sixth embodiment of the present invention which can solve a problem caused if the flying toner enters between a filter and a can will be explained.

If toner enters between the filter and the cam, then the vibration condition of the filter will be unstable, thereby worsening the stable separating operation.

Figure 15:
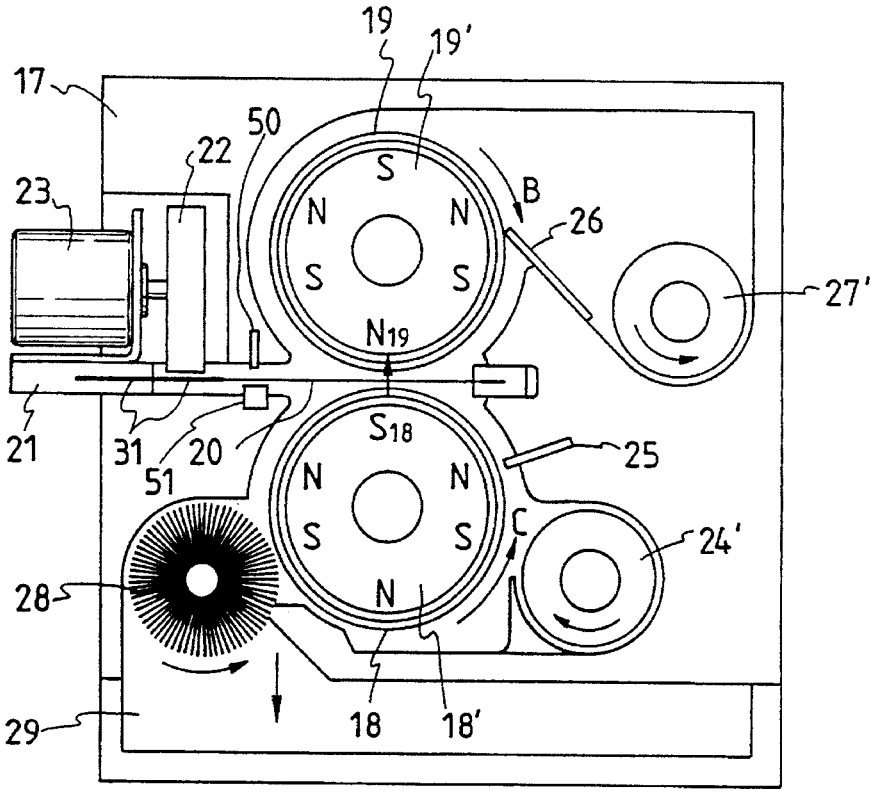
FIG. 15 is a sectional view of a developer extracting apparatus according to a sixth embodiment of the present invention.
Figure 16:
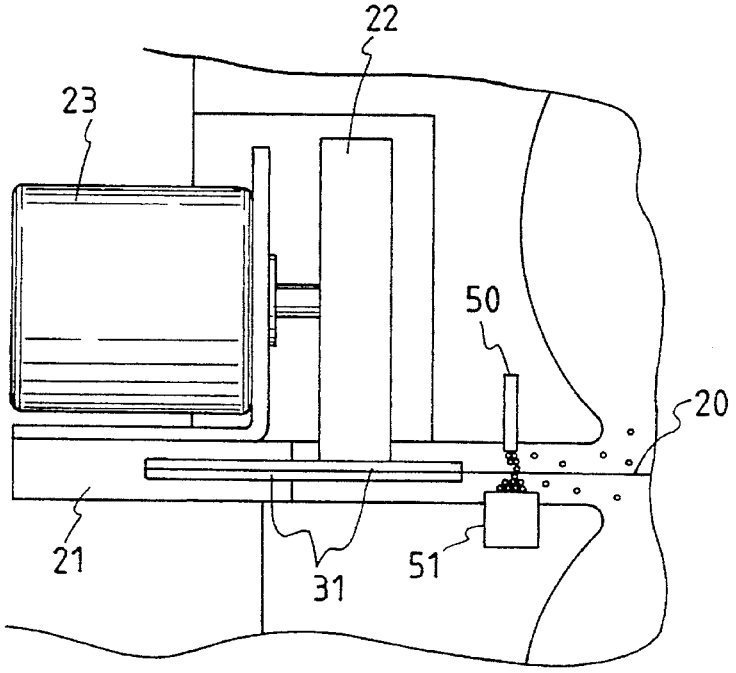
FIG. 16 is a view showing a seal portion of FIG. 15 in detail.

FIG. 15 is a sectional view of a developer extracting apparatus according to the sixth embodiment, and FIG. 16 is a detailed view showing a seal portion which is not contacted with a mesh.

In FIGS. 15 and 16, the developer extracting apparatus 17 includes a mesh 20 arranged substantially horizontally and made of non-magnetic material (i.e. formed from non-magnetic stainless steel wires, non-magnetic brass wires or nylon fibers, for example), which mesh is pinched by a pair of non-magnetic flexible sheets 31 (each formed from a thin stainless steel leaf spring plate or a thin phosphoric bronze leaf spring plate). Further, sleeves 18, 19 including magnets 18', 19' therein, respectively, are arranged below and above the mesh 20, respectively, which sleeves are rotated in directions shown by the arrows C, B by a drive means (not shown). In a separating station between the sleeves, a magnetic force $N_{19}$ on the sleeve 19 and a magnetic force $S_{18}$ on the sleeve 18 are selected to have a relation $N_{19}>S_{18}$. The vibration is applied to the flexible sheets 31 by a cam 22 connected to a drive motor 23 secured to a holding member 21 for holding the mesh 20, and the vibration is transmitted to the mesh 20 through the flexible sheets 31. A magnet 50 and a magnetic plate 51 are arranged on both sides of the mesh to generate a concentrated magnetic field. A convey screw 24' serves to convey residual matter collected by a cleaner from that side to this side, and a convey screw 27' serves to convey toner from this side to that side, thereby discharging the toner out of the apparatus. Thereafter, the toner is re-supplied to a developing device (including a hopper portion). The thickness of a layer of the residual matter formed on the sleeve 18 is regulated by a doctor blade 25, and a blade 26 serves to scrape the toner from the surface of the sleeve 19. A non-magnetic brush 28 is rotated in the same direction as the sleeve 18 and adapted to scrape off the residual toner and other non-magnetic foreign matters remaining on the sleeve 18 into a collecting portion 29.

The toner and other foreign matters (which were not transferred to the sheet P by the transfer separation charger 4) remaining on the image bearing member 1 are scraped by the cleaner 5. The scraped toner and other foreign matters are conveyed to the above-mentioned developer extracting apparatus by a convey means (not shown). That is to say, the residual matter scraped off by the cleaner 5 is conveyed into the developer extracting apparatus toward the sleeve 18 by the convey screw 24'. The magnetic toner is adhered to the sleeve 18 by the magnetic force, and is conveyed upwardly as the sleeve 18 is rotated; meanwhile, the thickness of the layer formed on the sleeve 18 is regulated to a predetermined value by the doctor blade 25, and then, the toner is sent to the separating station where the sleeves 18, 19 are opposed to each other. Since the relation between the magnetic forces $N_{19}$ and $S_{18}$ at the separating station is selected to be $N_{19}>S_{18}$, the toner is effectively attracted by concentrated lines of magnetic force extending from the magnetic pole $S_{18}$ to the magnetic pole $N_{19}$, so that only the toner is absorbed to the sleeve 19 through the mesh 20 upwardly by the magnetic force $N_{19}$. Since the mesh 20 has openings greater than a particle diameter of the toner by several times, in an initial clean condition of the mesh, the toner can pass through the mesh smoothly. However, as the developer extracting apparatus is operated continuously, since the partially aggregated toner is adhered to the wires forming the mesh, or, under the high temperature condition where the aggregation of the toner is promoted, since the aggregated toner blocks cannot pass through the openings of the mesh, the mesh may be clogged or jammed with toner.

However, in the illustrated embodiment, since the vibration is firstly applied to the thin non-magnetic flexible sheets 31 (preferably, having a thickness of 0.05–0.2 mm) under the action of the cam 22 driven by the drive motor 23 and the vibration is then transmitted to the mesh 20 through the flexible sheets 31, aggregation of the toner adhered to the mesh 20 is broken due to the vibration, thereby recovering or curing the clogging of the mesh 20 to permit the easy separation of the toner from the other foreign matters. Further, since the mesh 20 is pinched between the flexible sheets 31, even when the flexible sheets 31 are very thin, such sheets have adequate restoring ability for deformation caused by the vibration. Thus, the flexible sheets 31 can be vibrated minutely to transmit the vibration to the mesh 20, thereby vibrating the mesh 20 effectively without deformation of the mesh. Further, since the flexible sheets 31 have a thickness of about 0.05–0.2 mm, even when the flexible sheets are vibrated, the vibration noise is very small, which cannot be heard outside the apparatus. Further, in this case, at the separating station, while the magnetic toner is separated and conveyed from downward to upward, during the conveyance, if a portion of the toner is released from the magnetic force, such toner will be floating in a space within the container of the apparatus. However, since the space within the container including the sleeves 18, 19 is closed, the floating toner is prevented from leaking outside. Since the mesh 20 extends to the vibration applying portion, the separating station is spatially communicated with the vibration applying portion.

Figure 18:
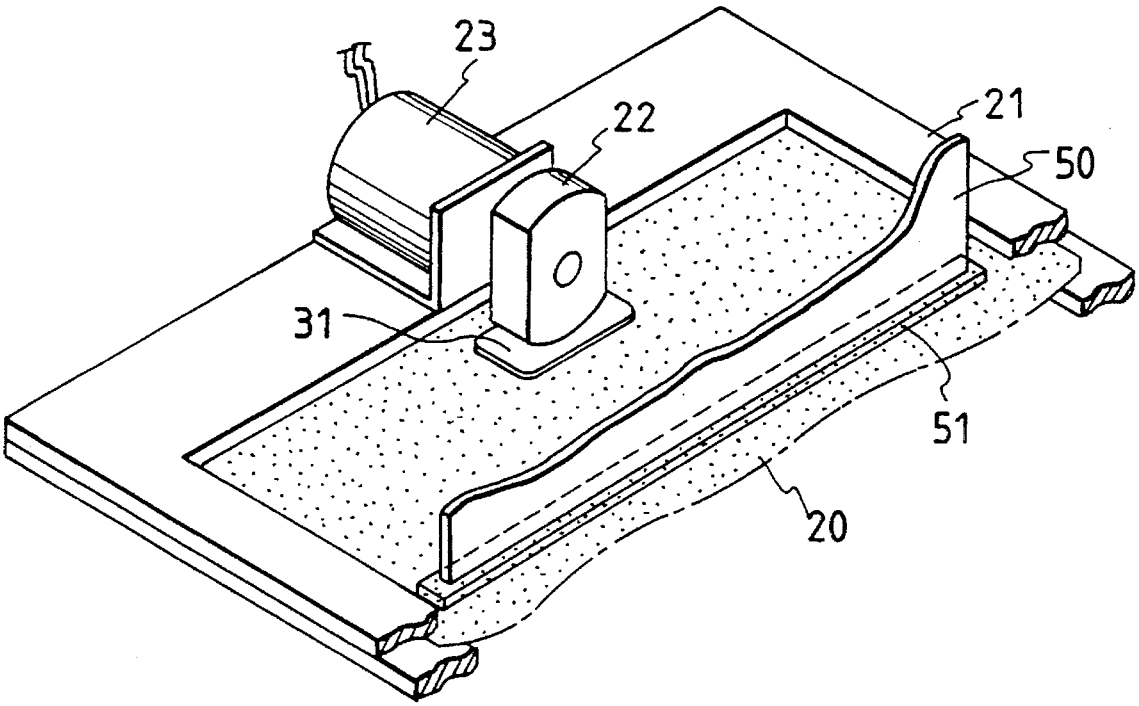
FIG. 18 is a perspective view of the seal portion of FIG. 16.

However, even if floating toner is shifted toward the vibration applying portion in the space, as shown in FIGS. 16 and 18, since the floating toner is caught by the concentrated magnetic field generated by the magnet 51 and the magnetic plate 50 (shield means), the toner cannot reach the vibration applying portion. Further, as the apparatus is used continuously, toner is gradually accumulated on the magnet 51 and the magnetic plate 50. However, since the adhered toner has a particle diameter of about 10 μm, the connection of the toner particles is flexible.. Thus, if the adhered toner particles are contacted with the mesh 20, the vibration of the mesh 20 is not attenuated, with the result that the vibration applied by the vibration applying portion can be transmitted to the separating station effectively.

Further, since the weight of the toner itself is small, by setting the magnetic force to create a conveying force greater than the weight of the toner, the toner can easily be conveyed upwardly to be adhered to the sleeve 19. Further, in the illustrated embodiment, since the toner is conveyed upwardly in opposition to the gravity force of the toner to separate the toner from the other foreign matters, the non-magnetic matters ( foreign matters ) separated from the toner are adhered to the under surface of the mesh 20. Accordingly, such foreign matters are separated from the mesh due to the vibration of the mesh and are dropped downwardly by their own weights. Thus, the toner can be separated from the foreign matters effectively, and the clogging of the mesh 20 can be prevented continually.

Further, the toner separated from foreign matters and adhered to the sleeve 19 is conveyed downstream as the sleeve 19 is rotated. Meanwhile, toner is scraped off of the sleeve 19 by the scraper blade 26, and the scraped toner is conveyed out of the apparatus by means of the convey screw 27'.

Then, the separated toner is conveyed to the developing system by the convey means (not shown) to be reused in the developing operation.

The foreign matters separated from the mesh at the separating station are dropped onto the sleeve 18 and are further conveyed together with the toner (which was not shifted toward the sleeve 19) remaining on the sleeve 18. Then, the foreign matters are removed from the sleeve 18 by the non-magnetic brush 28 disposed at a downstream side of the separating station. Since the non-magnetic brush 28 is abutted against the sleeve 18 with a weak abutting force, the foreign matters adhered to the sleeve 18 with a weak force can be scraped off of the sleeve. However, since the toner which was not separated at the separating station and remaining on the sleeve 18 is adhered to the sleeve by a magnetic force, such residual toner cannot be scraped off by the non-magnetic brush 28, but is further conveyed downwardly for the next separation. Thus, almost all of the toner is not collected in the collecting portion 29, and only the non-magnetic foreign matters are collected in the collecting portion 29.

As mentioned above, by breaking the aggregation of the toner and by dropping the foreign matters from the mesh downwardly under the action of the gravity force, clogging of the mesh is always prevented to permit effective and continuous separation between the toner and the foreign matters for a long time. Further, since the floating toner can be caught by the concentrated magnetic field generated by the magnet and the magnetic plate (seal means) disposed in the space between the vibration applying portion and the separating station without contacting the mesh, the vibration applied to the mesh at the vibration applying portion can be effectively transmitted to the separating station without attenuation, thereby maintaining the separating ability continuously.

Figure 17:
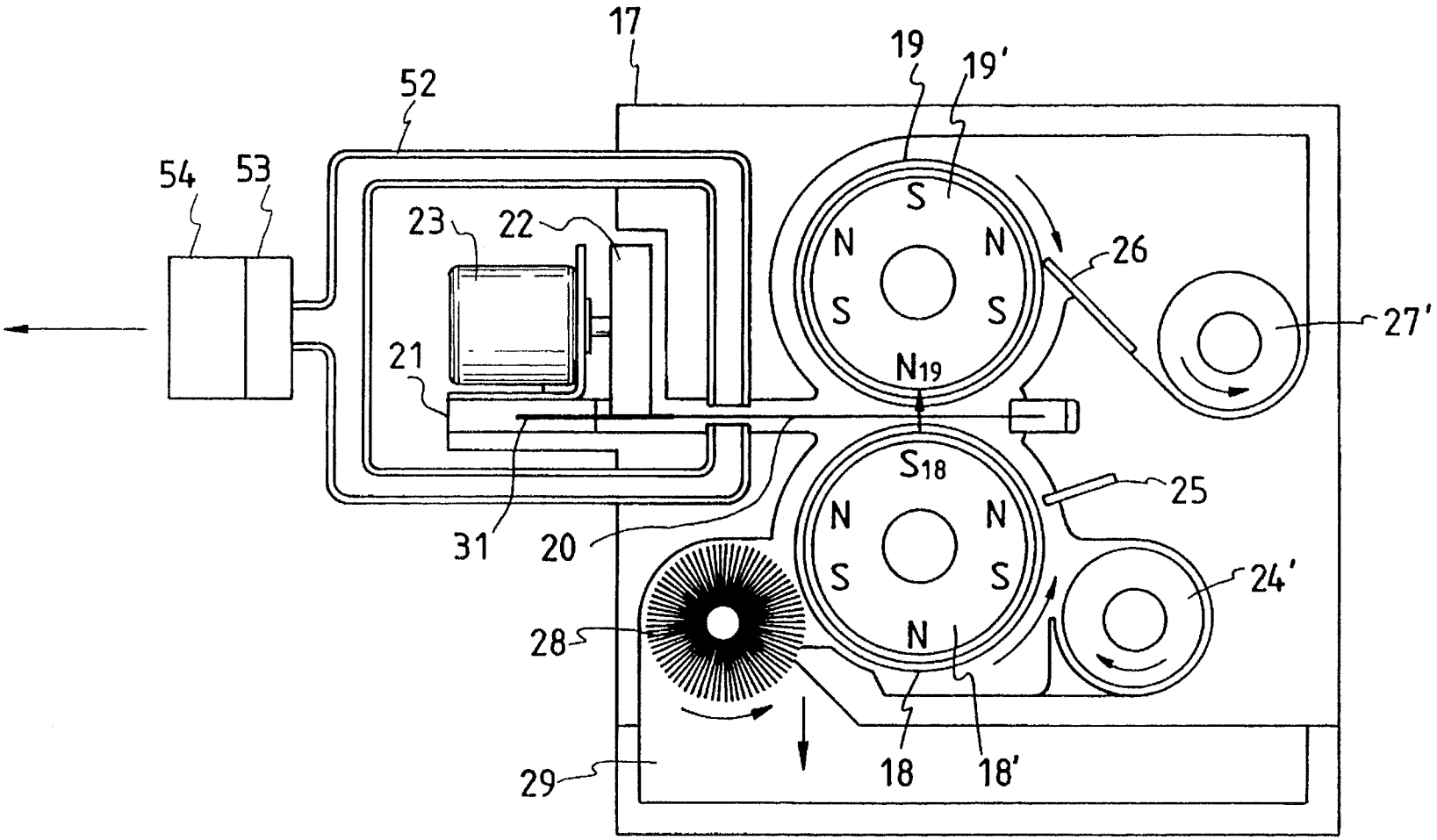
FIG. 17 is a sectional view of a developer extracting apparatus according to a seventh embodiment of the present invention.

FIG. 17 is a sectional view showing a seventh embodiment of the present invention wherein an air seal created by an air suction duct is used as a seal means (shield means).

An air suction duct 52 is disposed between the vibration applying portion and the separating station, and air in the suction duct is sucked by a suction fan 54 through a filter 53. A suction force is not so strong that air flows into the suction duct 52. Since the mesh 20 extends to the vibration applying portion, the separating station communications with the vibration applying portion. However, even if floating toner is shifted toward the vibration applying portion in the space, since the toner has a particle diameter of about 10 μm, the toner is sucked into the suction duct along the air flow created by the suction duct 52. Thus, the floating toner does not reach the vibration applying portion. Further, since the seal means is not contacted to the mesh 20, the vibration applied to the mesh 29 by the vibration applying portion can be effectively transmitted to the separating station without attenuation. The floating toner sucked by the suction duct 52 is further conveyed outwardly and then is caught by the filter 53. Accordingly, only air is discharged out of the apparatus.

Incidentally, in the above-mentioned embodiment, while an example in which the seal means is not contacted to the mesh-shaped filter was explained, the present invention is not limited to this example. For example, a seal member such as a molt plane seal which is contacted with the mesh-shaped filter to prevent the floating toner from entering into the vibration applying portion may be used. However, in consideration of the attenuation of the vibration, a seal means of the non-contact type is more preferable.

Further, the present invention is not limited to the above-mentioned first to seventh embodiments. For example, the present invention can be applied to apparatuses wherein the residual matter is supplied onto a mesh-shaped filter, and the filter is vibrated to drop only the toner, thereby separating the toner from the other foreign matters. However, as shown in the above-mentioned embodiments, more effective technical results can be achieved when the present invention is applied to an apparatus wherein the toner is separated from the other foreign matters by passing the toner through the filter from downward to upward (in opposition to the gravity force).

As mentioned above, according to the present invent ion, since the protect ion member is disposed on the portion of the filter and the vibration is transmitted to the filter via the protection member, it is possible to prevent the openings of the mesh-shaped filter from being widened and to stabilize the transmission of the vibration to the separating station where the toner is separated from the other foreign matters, thereby maintaining an excellent separating ability for a long time.

Further, since the floating toner can be caught by the seal means, the vibration applying portion is not smudged with toner.

It should be noted that the present invention is not limited to the above-mentioned embodiments and various alterations and modifications can be effected within the scope of the present invention.

What is claimed is:

1. A developer extracting apparatus for extracting a developer from a mixture of the developer and foreign matter, comprising:

filter means for permitting passage of the developer but inhibiting passage of the foreign matter;

protection means for protecting said filter means; and vibration applying means for applying vibration to said filter means;

wherein said vibration applying means applies the vibration to said filter means via said protection means.

2. A developer extracting apparatus according to claim 1, wherein said filter means is a mesh.

3. A developer extracting apparatus according to claim 1, wherein said protection means is a sheet attached to a portion of said filter means.

4. A developer extracting apparatus according to claim 2, wherein said protection means is a rectangular sheet attached to the mesh in a direction transverse to a weaving direction of the mesh.

5. A developer extracting apparatus according to claim 3, wherein two sheets are attached to respective surfaces of said filter means, and one of said sheets is larger than the other one of said sheets.

6. A developer extracting apparatus according to claim 5, wherein said vibration applying means is abutted against the smaller sheet.

7. A developer extracting apparatus according to claim 4, wherein said sheet is attached to said mesh while inclining with respect to the weaving direction of the mesh by about 45 degrees.

8. A developer extracting apparatus according to claim 1, wherein said vibration applying means includes a cam for beating a surface of said protection means.

9. An image forming apparatus for forming a developer image on a recording material, comprising:

an image bearing member;

image forming means for forming a developer image on said image bearing member;

cleaning means for removing a residual matter from a surface of said image bearing member; and developer extracting means including filter means for permitting passage of the developer but inhibiting passage of the foreign matter, protection means for protecting said filter means, and vibration applying means for applying vibration to said filter means via said protection means.

10. An image forming apparatus according to claim 9, wherein said filter means is a mesh.

11. An image forming apparatus according to claim 9, wherein said protection means is a sheet attached to a portion of said filter means.

12. An image forming apparatus according to claim 10, wherein said protection means is a rectangular sheet attached to the mesh in a direction transverse to a weaving direction of the mesh.

13. An image forming apparatus according to claim 11, wherein two sheets are attached to respective surfaces of said filter means, and one of said sheets is larger than the other one of said sheets.

14. An image forming apparatus according to claim 13, wherein said vibration applying means is abutted against the smaller sheet.

15. An image forming apparatus according to claim 12, wherein said sheet is attached to said mesh while inclining with respect to the weaving direction of the mesh by about 45 degrees.

16. An image forming apparatus according to claim 9, wherein said vibration applying means includes a cam for beating a surface of said protection means.

17. An image forming apparatus according to claim 9, further comprising transfer means for transferring the developer image from said image bearing member to the recording material, and wherein said cleaning means removes the residual matter from the surface of said image bearing member after a transferring operation.

18. An image forming apparatus according to claim 9, further comprising developing means for supplying developer to said image bearing member, and convey means for conveying developer extracted by said developer extracting means to said developing means.

* * * * *

UNITED STATES PATENT AND TRADEMARK OFFICE

CERTIFICATE OF CORRECTION

PATENT NO. : 5,455,666

DATED : October 3, 1995

INVENTOR(S) : HIRONOBU SAITO, ET AL.

It is certified that error appears in the above-indentified patent and that said Letters Patent is hereby corrected as shown below:

Column 2

Line 63, "means." should read --means,--.

Column 3

Line 25, "are" should read --is--.

Column 4

Line 46, "downstreamly" should read --downstream--.

Column 6

Line 1, "port ion" should read --portion--.

Column 10

Line 23, "invent ion," should read --invention,--.

Line 24, "protect ion" should read --protection--.

Signed and Sealed this

Nineteenth Day of March, 1996

*Attest:*

Bruce Lehman

BRUCE LEHMAN

*Attesting Officer*

*Commissioner of Patents and Trademarks*